United States Patent [19]

Bachmann et al.

[11] Patent Number: 4,599,884

[45] Date of Patent: Jul. 15, 1986

[54] APPARATUS FOR TRANSFERRING RELATIVELY FLAT OBJECTS

[75] Inventors: Henry C. Bachmann; Omar L. Brown; Ermal C. Fraze, all of Dayton; James R. Gregg, Springboro; David K. Wynn, Dayton, all of Ohio

[73] Assignee: Dayton Reliable Tool & Mfg. Co., Dayton, Ohio

[21] Appl. No.: 571,051

[22] Filed: Jan. 16, 1984

[51] Int. Cl.[4] ..... B21D 45/00

[52] U.S. Cl. ..... 72/346; 72/361; 72/405

[58] Field of Search ..... 72/347, 348, 404, 405, 72/336, 345, 346, 427, 24, 361, 21, 22; 220/67, 66; 226/151; 198/772; 92/143, 162 R; 414/222

[56] References Cited

U.S. PATENT DOCUMENTS

| | | | |
|---|---|---|---|
| 2,291,243 | 7/1942 | Levy | 92/162 R |
| 2,820,542 | 1/1958 | Oswald | 198/772 |
| 2,840,026 | 6/1958 | Eggert | 72/346 |
| 3,080,983 | 3/1963 | Blatt | 72/426 |
| 3,391,590 | 7/1968 | Stein | 83/183 |
| 3,683,665 | 8/1972 | Bradlee | 72/405 |
| 3,866,471 | 2/1975 | Carroll et al. | 72/405 |
| 3,911,719 | 10/1975 | Degenhardt et al. | 72/345 |
| 3,952,677 | 4/1976 | Hartman et al. | 220/66 |
| 3,957,005 | 5/1976 | Heffner | 72/348 |
| 4,026,226 | 5/1977 | Hahn et al. | 72/405 |
| 4,062,213 | 12/1977 | Schneider et al. | 72/21 |
| 4,120,185 | 10/1978 | Schneider et al. | 72/21 |
| 4,157,693 | 6/1979 | Openclowski et al. | |
| 4,215,795 | 8/1980 | Elser | 220/67 |
| 4,382,737 | 5/1983 | Jensen et al. | 72/348 |
| 4,448,322 | 5/1984 | Kraska | 220/67 |

FOREIGN PATENT DOCUMENTS

| | | | |
|---|---|---|---|
| 255869 | 7/1967 | Austria . | |
| 681270 | 3/1964 | Canada | 72/361 |
| 1535677 | 7/1968 | France . | |
| 1190791 | 5/1970 | United Kingdom | 72/21 |

*Primary Examiner*—Francis S. Husar
*Assistant Examiner*—Robert Showalter
*Attorney, Agent, or Firm*—Biebel, French & Nauman

[57] ABSTRACT

An apparatus for transferring a relatively flat object from a first station to a second station includes a support for the object at the first station, a substantially closed housing, and a piston disposed therein for sliding movement from a normal position to an activated position. An actuator extends through the housing and is integrally formed with the piston for sliding movement thereby. Compressed air is selectively directed into the housing for movement of the piston to the activated position, whereby the actuator strikes a blow edgewise of the object for propelling it toward the second station along a predetermined path. A pair of fingers disposed at the second station define therebetween a portion of the path along which an incoming object enters the second station. Each finger includes a path wall having an end surface extending generally inwardly from the finger for blocking the object path for halting object movement. A spring pawl extending partially into the path from each finger prevents rebounding of the object from the end surfaces.

4 Claims, 21 Drawing Figures

APPARATUS FOR TRANSFERRING RELATIVELY FLAT OBJECTS

BACKGROUND OF THE INVENTION

The present invention relates to an apparatus for the transfer of relatively flat objects from a first to a second work station and, more particularly, to such an apparatus that is adapted for use within equipment for the manufacture of shells used to close the ends of metal cans.

One common way of packaging liquids, particularly beverages such as beer, soft drinks, juices and the like, is within cans typically formed from aluminum. In such cans, the can body is either manufactured to include both the can side walls and an attached bottom end, or the bottom end is formed separately and subsequently joined to the side walls. The upper end, which includes the means by which the can is opened, is manufactured separately and attached to the can body after the can has been filled.

The can ends, often referred to within the art as shells, are generally manufactured within ram presses. While various particular methods of shell formation are known and available, it is often necessary within these methods to transfer the shells from a first to a succeeding work station. In view of the large quantities of cans and shells that are manufactured, it is desirable to be able to form quantites of the shells very rapidly. This necessitates a transfer system that is both quick and reliable.

While various conveyor and other types of transfer systems in which the objects are physically carried are known, such systems are generally disadvantageous for applications in the manufacture of shells. In order to remove a shell from a work station within a ram press, carry the shell, and then deposit the shell at a second station, particularly where positioning of the shell at the second station is critical, a relatively complex apparatus is required. This problem is compounded when the transfer process at each station must also be coordinated with the work operation being performed at the station. Moreover, at typical press speeds of several hundred strokes per minute, at least some portions of the transfer apparatus must be operated quite rapidly. Thus, such a system would be likely to require a number of rapidly moving parts in a complex structure with attendant high acceleration and deceleration forces, thereby resulting in an expensive piece of equipment with a relatively high potential for system malfunctions.

What is needed, therefore, is an apparatus for transferring shells between successive work stations that will enable the transfer to be made quickly and reliably. Moreover, such an apparatus must include means for accurately positioning each shell when necessary at the station to which it is transferred. The apparatus should, of course, be relatively simple, with as few moving parts as possible in order to increase reliability.

SUMMARY OF THE INVENTION

The present invention provides an apparatus for transferring a relatively flat object from a first station to a second station, and includes means for supporting the object at the first station. A substantially closed housing has a piston disposed in the housing interior at a normal position for sliding movement within the housing to an activated position. An actuator extends through the housing and is connected to the piston for sliding movement thereby. Compressed air may be selectively directed into the housing for moving the piston to its activated position, and a spring is provided for returning the piston to its normal position. The housing is located with respect to the object supporting means so that movement of the piston causes the actuator to strike a blow edgewise of the object for propelling it toward the second station along a predetermined path.

The apparatus may also include a pair of fingers disposed in a spaced relationship at the second station to define between the fingers a portion of the transfer path for an object, with the path portion so defined being of a width slightly greater than the object. Each of the fingers has a flange extending inwardly therefrom at substantially the top of each finger so as to extend at least partially over the path portion. Additionally, each finger further includes a path wall having an end surface extending generally into the object path at a location along each finger remote from the point of entry of a shell between the fingers. Each end surface extends inwardly sufficiently to block a portion of the object path for halting movement of the object.

A spring pawl carried within each of the fingers extends partially into the object path and is constructed to permit movement of the object therepast for entering the pathway. In addition, the pawls prevent movement of the object therepast in the reverse direction, and are positioned along the fingers for preventing rebounding of the object from the end surfaces.

In one embodiment of the present invention, the object transfer apparatus is used within a conventional single-action ram press for the transfer of shells used as can ends from a first work station to a second. The first station includes an upper tooling having a working surface and a cooperating lower tooling, the upper tooling being lowerable by the press ram for working the shell therebetween and subsequently raisable by the ram. Means for supplying a partial vacuum to the upper tooling working surface through at least one vacuum orifice defined therein is provided so that the shell may be held on the working surface after the upper tooling is at least partially raised from the lower tooling.

Compressed air may be selectively directed into the housing by a valve means, in which case a control means for actuating the valve means is also provided. The control means is adapted to actuate the valve means in response to a predetermined position within the press ram stroke cycle. In the preferred embodiments, the predetermined position within the stroke cycle is within the portion of the cycle wherein the upper tooling is at least partially raised from the lower tooling.

Accordingly, it is an object of the present invention to provide an apparatus for transferring a relatively flat object from a first station to a second station wherein the object is struck an edgewise blow at the first station to direct it to the second; to provide such an apparatus that accomplishes the transfer of the object quite rapidly and reliably; to provide such an apparatus that includes relatively few moving parts and that enables the transfer to be effected without the physical carrying of objects between the stations; and to provide such an apparatus that may be used with a conventional designed and constructed single-action ram press.

Other objects and advantages of the invention will be apparent from the following description, the accompanying drawings, and the appended claims.

DETAILED DESCRIPTION OF PREFERRED EMBODIMENTS

The shell making method with which the present invention is used may be generally divided into two operations, each of which is carried out within a conventional single-action ram press having a specially adapted tooling and control system. In accordance with the preferred embodiment, the press utilized is a Minster P2-45, although many other models are also suitable for use. Further, each of the two operations could be carried out in separate presses.

Initially, the relatively thin metal stock from which the shell is ultimately formed is fed to one or more stations within the press. The press ram operates at each of these first stations to separate a blank from the stock, and to partially form the shell from the blank.

The partially completed shell formed at each of the first stations is then transferred to a corresponding second station within the same press, whereupon the second portion of the method is begun. As the press ram is again lowered, the forming of the shells is completed at the second stations. Once the press is opened, the completed shells are transferred out of the press.

The apparatus is constructed so that for each stroke of the press, a partially formed shell is finished within each second station while a blank is produced and partially formed within each first station. Moreover, the transfer of shells between stations is accomplished so that a shell partially formed in a first station by one press stroke is completed at the second station by the next succeeding stroke.

First Station Tooling and Operation

Figure 1:
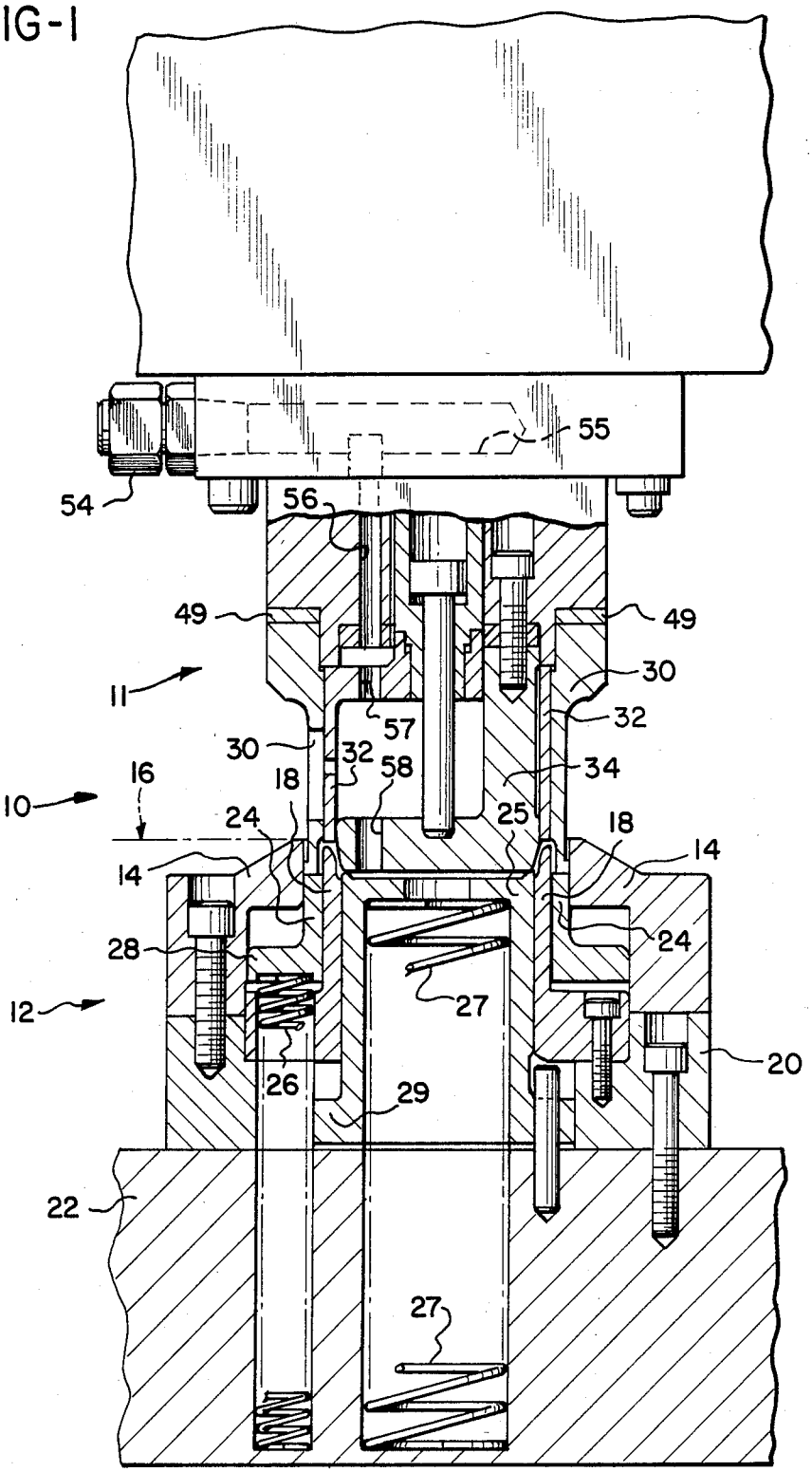
FIG. 1 is a cross-sectional view illustrating the tooling of a first station within the shell-forming apparatus with which the present invention is used.

The press tooling for each of the first stations 10 is shown generally in FIG. 1. The upper tooling 11 is connected for operation by the press ram, while the lower tooling 12 is fixedly mounted to the press frame.

Lower tooling 12 includes die cut edge 14, over which the metal stock enters the tooling at a level generally indicated by line 16. Die cut edge 14, along with die form ring 18 are solidly supported by block member 20 which is in turn supported by base member 22. Additionally, lower tooling 12 includes draw ring 24, positioned between die form ring 18 and die cut edge 14. A center pressure pad 25 is located concentrically within form ring 18. Draw ring 24 is supported by four springs 26 (only one shown) mounted in base member 22. Springs 26 are shown in FIG. 1 in a compressed condition, caused by pressure exerted upon draw ring 24 when the tooling is closed. The center pressure pad 25 is supported by spring 27 mounted within pressure pad 25 and base member 22 central to the first station tooling. Spring 27 is also shown in a compressed condition from force exerted by the upper tooling 11.

When the tooling is open, draw ring 24 and center pressure pad 25 are retained in the lower tooling 12 by flanges 28 and 29 integrally machined on the respective tooling portions with draw ring 24 bottoming against die cut edge 14 and center pressure pad 25 against form ring 18. In such case, the uppermost surface of draw ring 24 is at a position some distance below the lowest point of shear on the die cut edge 14, while the uppermost surface of the center pressure pad 25 is some distance above draw ring 24 and below lowest point of shear on die cut edge 14.

Upper tooling 11 is provided with blank punch 30 which is positioned to cooperate with draw ring 24 for compression of spring 26 as the tooling is closed. A knockout and positioner 32 is located above die form ring 18, and punch center 34 is provided with an appropriate configuration to produce the partially completed shell, as well as to clamp a blank in cooperation with center pressure pad 25. Blank punch 30, knockout and positioner 32, and punch center 34 are all closed simultaneously upon lower tooling 12 as the press ram is lowered. These tools can be seen in detail in FIGS. 1*a*–1*c*.

Figure 2:
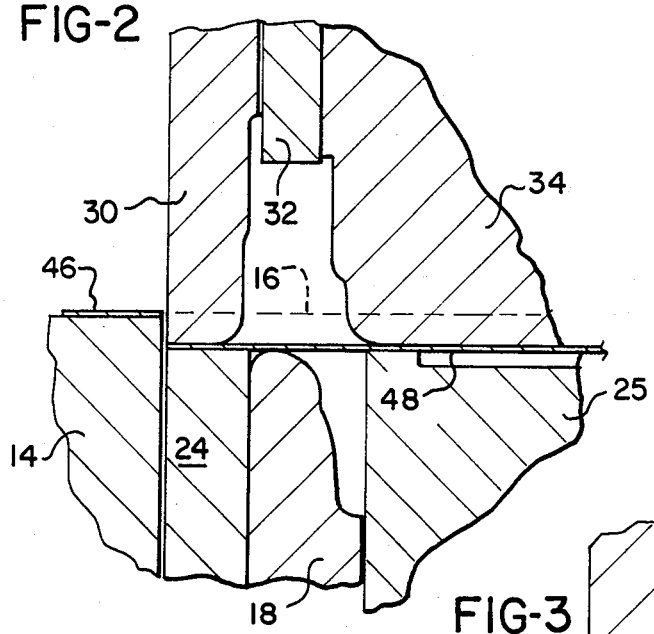
FIG. 2 is a cross-sectional view of a portion of the first station tooling illustrating its operation for shell formation.
Figure 3:
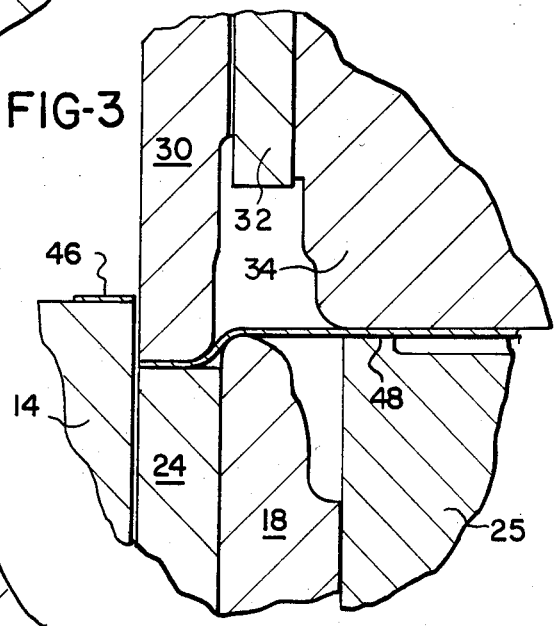
FIGS. 3, 4 and 5 are views similar to FIG. 2 illustrating the sequential operation of the first station tooling.

The operation of the first station tooling 10 to produce the blank from the stock and partially form a shell is shown in detail in FIGS. 2–5. In FIG. 2, the tooling is shown already partially closed. The stock 46 initially entered the tooling along a line indicated at 16, and as the press ram is lowered, a flat blank 48 is produced by shearing the stock material between die cut edge 14 and blank punch 30.

Since the blank punch 30 and punch center 34 move simultaneously, the lowermost surface of blank punch 30 must lead the lowermost surface of punch center 34 by some distance so that punch center 34 does not interfere with the stock 46 during blanking. Referring briefly back to FIG. 1, a spacer ring 49 is provided behind blank punch 30 for setting the lead distance between punch center 34 and blank punch 30.

Further, the distance by which blank punch 30 leads punch center 34 is less than the distance at which the uppermost surface of center pressure pad 25 is above the uppermost surface of draw ring 24 in lower tooling 12. This allows a blank 48 to be clamped between punch center 34 and center pressure pad 25 first, followed by clamping of blank 48 between blank punch 30 and draw ring 24 before any forming begins. Use of the central clamping secures the blank 48 in a centered position within the tooling during forming of a shell from the blank, as will be described herein.

As the press ram continues downward, the blank punch 30, support ring 32, and punch center 34 all continue to move simultaneously. At the point illustrated in FIG. 3, the blank 48 is still pinched between blank punch 30 and draw ring 24, and between punch center 34 and center pressure pad 25, beginning the formation of the shell over die form ring 18. It will be noted that as the blank 48 is formed over form ring 18, it is pulled from between blank punch 30 and draw ring 24.

Figure 4:
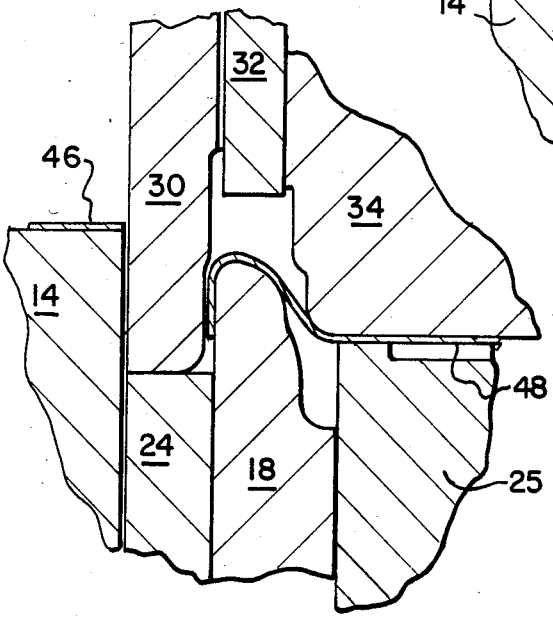

Referring now to FIG. 4, the press ram continues to move downward as the punch center 34 begins to form the panel of shell 48 (heretofore referred to as blank 48). The shell material is no longer held between the blank punch 30 and the draw ring 24, but is still contained between punch center 34 and center pad 25, and the draw ring 24 no longer controls the formation of the shell. The clearance between the inside diameter of the blank punch 30 and the outside diameter of the die form ring 18 is selected to provide an appropriate amount of drag or resistance on the shell 48 to insure proper formation. The inside diameter of blank punch 30 slightly narrows above the curves shown at 49 (shown exaggerated for clarity). Thus, near the end of the press stroke, as can be seen by comparing FIGS. 4 and 5, the drag on the outermost portion of shell 48 is increased. This is to insure that this portion of shell 48 is drawn more tightly over die form ring 18 so that the curl formed in shell 48 extends to the very edge of shell 48, without any straight or less than fully curled portions.

Figure 5:
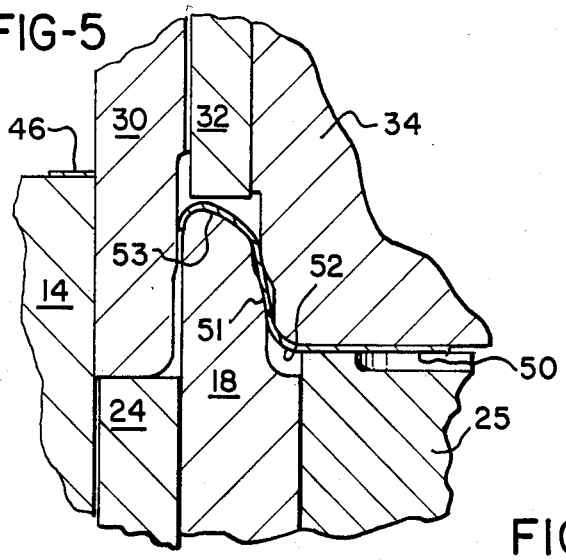

In FIG. 5, the tooling is shown in its closed position with the press ram bottomed against appropriate stop blocks. The first portion of the shell formation operation is completed, with a shell 48 being formed having a flat panel 50 terminating at a relatively large radius area 52 to produce a soft stretch so as not to overwork shell material in this area. The large radius area 52 forms the junction region of chuckwall 51 with the panel 50, and will later form the shell countersink and panel form radius. A sufficiently large radius is provided so that a much tighter radius can later be provided for the shell countersink while maintaining sufficient material thickness. It can be seen from FIG. 5 that the reverse bends applied to the inner wall of die center form ring 18 and the outer wall of punch center 34 serve to produce a straight chuckwall 51 without either inward or outward bowing, enabling shell 48 to fit accurately within the second station tooling.

The shell is further provided with a lip 53 extending generally outwardly and upwardly from the chuckwall 51, but having general downward curvature. Lip 53 is provided with two distinct curvatures, giving lip 53 a "gull-wing" cross-sectional configuration, with the portion adjacent chuckwall 51 having only slight relative curvature and thus providing the upward extension of lip 53. The outermost portion is provided with a relatively sharp downward curvature by die center form ring 18, although the lowermost portion of the outer edge of lip 53 is formed to at least even with, if not above, the point where lip 53 connects with the shell chuckwall 51.

It will be noted that upon closure of the tooling, knockout and positioner 32 does not contact shell 48. Once the forming operation has been completed, the press ram is raised to open the tooling. As the tooling is opened, shell 48 is held within blank punch 30 by the tight fit of shell 48 therein caused during its formation and is carried upward by upper tooling 11. For reasons that will be described in detail below, once the lowermost portion of shell 48 has cleared the stock level indicated in FIG. 1 at 16, knockout and positioner 32 halts its upward movement of the position relative blank punch 30 and punch center 34 shown in FIG. 1*b*, while blank punch 30 and punch center 34 continue to rise with the press ram toward the uppermost portion of the press stroke shown in FIG. 1*c*. When the upward movement of knockout and positioner 32 is stopped, shell 48 will contact knockout and positioner 32 which knocks out, or pushes, shell 48 from within the still-moving blank punch 30.

The shell 48 is then held in position on knockout and positioner 32 through application of a vacuum to shell 48. An appropriate fitting 54 is provided for connection to a conventional shop vacuum supply, and passageways 55, 56, 57 and 58 are provided through upper tooling 11 to support the vacuum to the surface of punch center 34. This vacuum then causes the shell 48 to adhere to the surface of knockout and positioner 32.

Upon completion of the first operation upon the shell, it is moved by the transfer system of the present invention, to be described in detail below, to a corresponding one of a plurality of second stations for completion of the formation process.

Second Station Tooling and Operation

Figure 6:
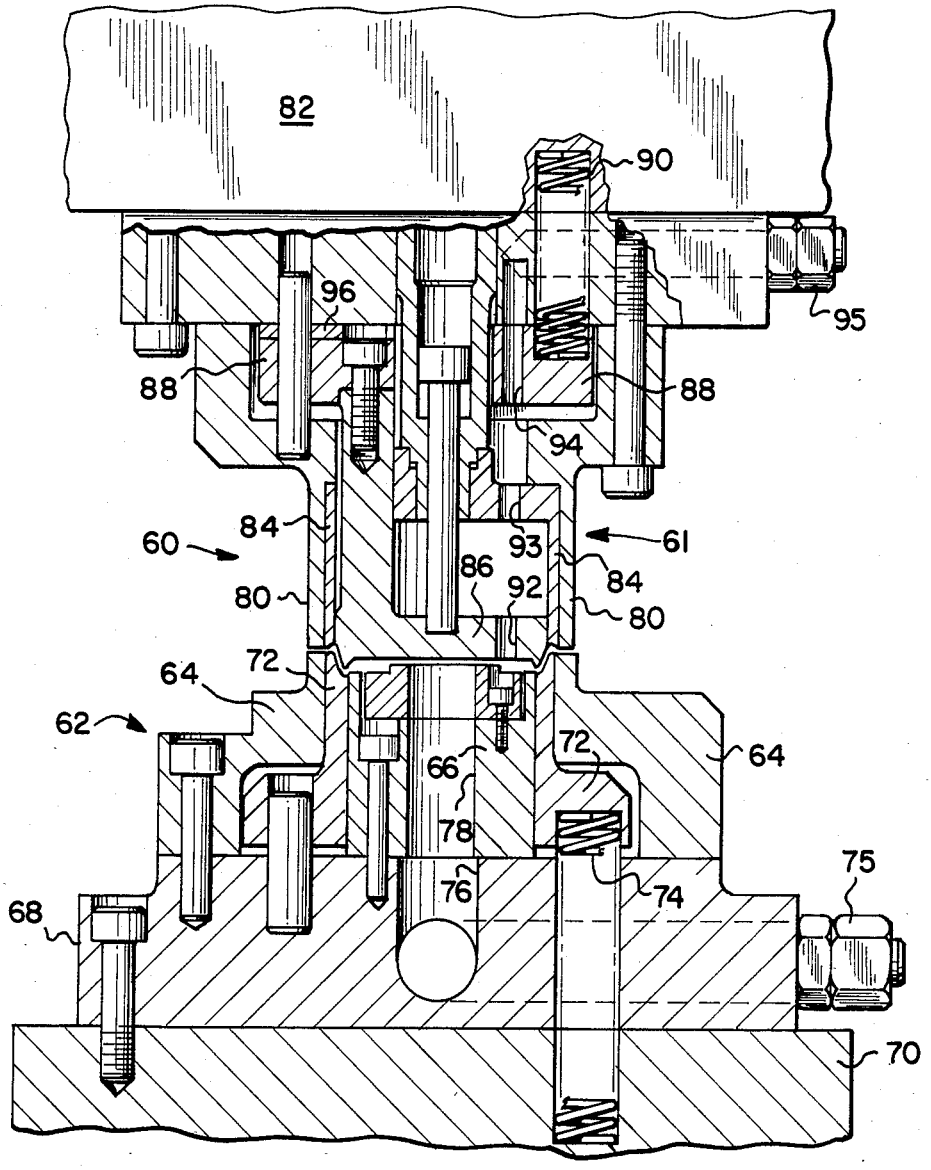
FIG. 6 is a cross-sectional view showing the tooling of a second station of the shell-forming apparatus.

The tooling for the second station 60 is shown in detail in FIG. 6. Upper tooling 61 connected to the press ram and lower tooling 62 fixedly secured to the press frame are provided, shown in their closed positions.

Lower tooling 62 includes a curl die 64 and panel form punch 66, both mounted in turn to base members 68 and 70. An insert 71 is mounted within panel form punch 66. A spring pressure pad 72 is concentrically mounted between curl die 64 and panel form punch 66, supported by a plurality of springs 74 (only one shown) mounted in member 70 and extending through member 68. An appropriate fitting 75 for connection to a vacuum pump is provided, with vacuum passageways 76, 77 and 78 formed through member 68, panel form punch 66 and insert 71, respectively, applying the vacuum to the upper surface of panel form punch 66 insert 71.

Upper tooling 61 is provided with a retainer 80 connected to upper base 81, mounted in turn to die shoe 82 for movement by the press ram. A form punch and positioner 84 is also provided for downward movement along with retainer 80, and includes a projection 85 for defining the forming characteristics of the lower surface of form punch and positioner 84. Additionally, panel form die 86 is mounted generally for movement along with retainer 80 and form punch and positioner 84. Panel form die 86 is attached to the lower side of mounting block 88, which is in turn connected to the lower ends of a plurality of springs 90 (only one shown). Springs 90 are secured to the press ram 82. As will be described in detail below, springs 90 are selected to provide a "dwell" in the downward movement of panel form die 86 as the press ram 82 is lowered.

Vacuum passageways 92, 93, and 94 are provided through panel form die 86, form punch and positioner 84, and mounting block 88, respectively, communicating in turn through an appropriate vacuum fitting 95 and connection thereto to a vacuum pump. Vacuum may be thus supplied to the lower face of panel form die 86.

The operation of the tooling of each of the second stations 60 for completion of a shell is shown in detail in FIGS. 7–10. The shell 48 enters the open tooling of the second station 60 from the first station 10, and is properly positioned on lower tooling 62. The large radius area 52 and chuckwall 51 are supported by the spring pressure pad 72, with the entire panel 50 some distance above panel form punch insert 71. Shell 48 is located and held in place by vacuum applied to shell 48 through passageway 78 within insert 71.

Figure 7:
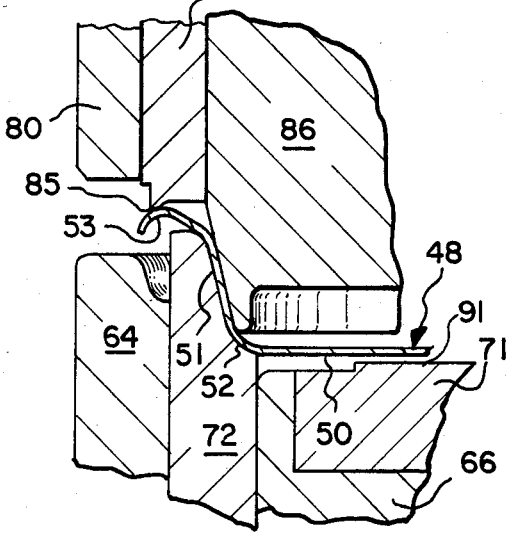
FIG. 7 is a cross-sectional view of a portion of the second station tooling illustrating its operation for shell formation.

In FIG. 7, lowering of the press ram causes panel form die 86 to contact chuckwall 51, clamping it between panel form die 86 and spring pressure pad 72. Spring 90 is selected to be more easily compressible than spring 74, so that once contact with chuckwall 51 is made, panel form die 86 is held in position by spring pressure pad 72 and begins to dwell despite further lowering of the press ram. Simultaneously, form punch and positioner 84 contacts shell lip 53.

Figure 8:
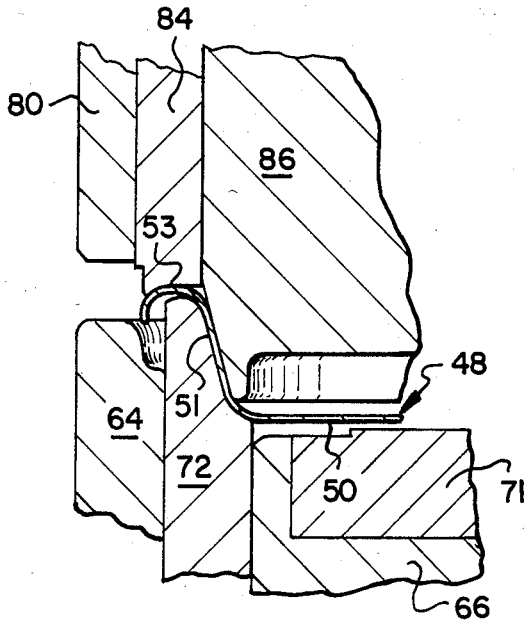
FIGS. 8, 9 and 10 are views similar to FIG. 7 illustrating the sequential operation of the second station tooling.

As seen in FIG. 8, continued downward movement of the press ram causes the form punch and positioner 84 to begin to push shell lip 53 toward its intended final location. Shell 48 continues to be clamped between panel form die 86 and spring pressure pad 72, with panel form die 86 continuing to dwell until downward movement of the press ram causes mounting block 88 to bottom against spacer 96, shown in FIG. 6.

Figure 9:
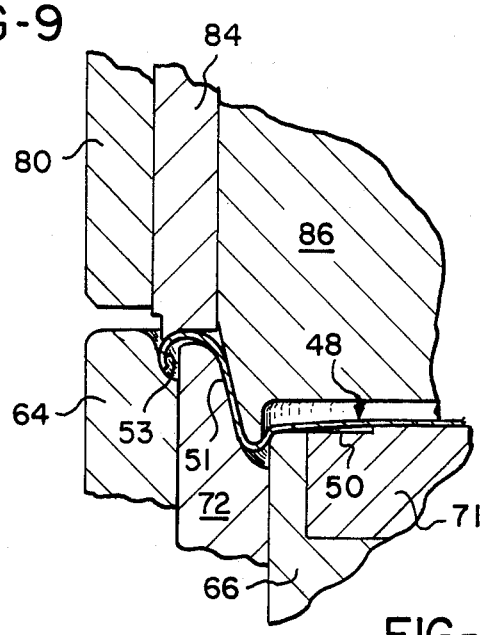

Once mounting block 88 has bottomed against spacer 96, further downward movement of the tooling by the press ram causes the panel form die 86 to move downward, as shown in FIG. 9, forcing the spring pressure pad 72 to move downward as well. Panel form punch insert 71 includes a raised center portion 91, and the raised portion 91 now becomes positioned against the shell panel 50. Downward movement of spring pressure pad 72 effectively causes upward movement of the shell panel 50 with respect to the remainder of shell 48, reducing the distance between the uppermost portion of shell 48 and the panel 50. The shell material from the large panel radius area 52 of FIG. 7 begins to pull away from the spring pressure pad 72 and wrap around the edges of the panel form punch 66 and the panel form die 86. The wrapping action takes place with little drawing of the shell material, to produce a pressure resistant panel for the completed shell by reforming the large radius area 52 into the countersink 98. Raised center portion 91 of insert 71 causes panel 50 to be bowed slightly upward to counteract a discovered tendency of panel 50 to bow downwardly during shell formation, resulting in a flat finished panel. Simultaneously with formation of countersink 98, the shell lip 53 enters the curl die 64 for final shaping.

Figure 10:
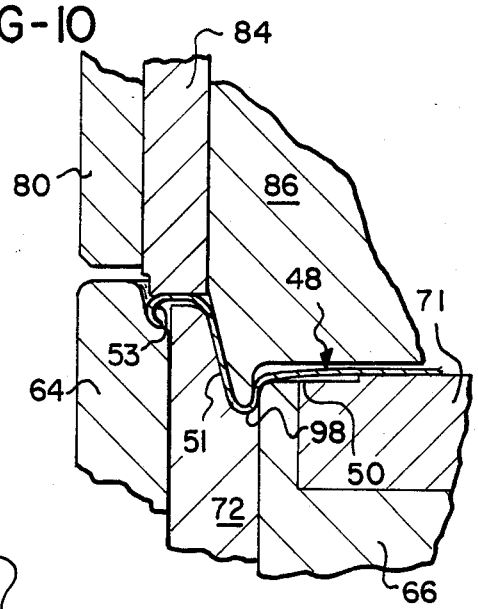

The tooling is shown in its closed position in FIG. 10. As part of the completed shell 48, a pressure resistant panel 50 surrounded by countersink 98 and a die curled lip 53 having a hook portion, i.e. an outer curl edge section of relatively lesser radius of curvature, suitable for seaming onto a can are provided. The reasons for formation of the "gull-wing" lip 53 at the first station 10 should now be readily appreciated. By pre-curling the outer portion of lip 53 to a relatively sharp radius extending completely to the edge of shell 48, the natural tendency of the outermost edge to resist die curling and remain relatively straight can be overcome. Moreover, by forming the less sharply curved portion of lip 53 at the first station so as to extend upwardly as well as outwardly from chuckwall 51, some travel distance for lip 53 during die curling of the outermost portion is provided. If lip 53 were to be formed at the first station to extend from chuckwall 51 at the final desired angle, die curling of the outer edge could only be accomplished through transverse movement of some portion of the second station tooling.

Figure 10A:
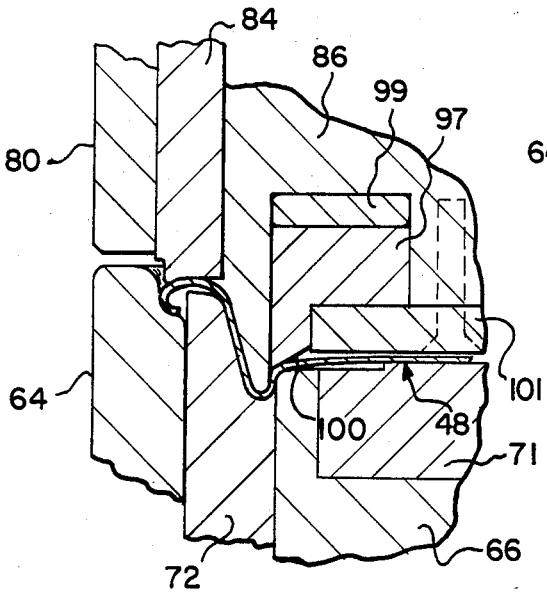
FIG. 10*a* is a view similar to FIG. 10, showing an alternate embodiment for the second station tooling incorporating coining tools.

An alternative embodiment for the upper tooling 61 is shown in FIG. 10*a*, wherein the completed shell is coined about the outer edge of panel 50 adjacent countersink 98 for additional strength. While coining of shells is typically performed in a separate coining press, the embodiment of FIG. 10*a* enables coining to be performed as part of the forming process, eliminating the need for separate equipment and a separate process. The central portion of panel form die 86 is provided with an annular recess into which a coining ring 97 and a spacer 99 are placed. Coining ring 97 is in turn secured by retainer 101 which is attached to panel form die 86. Spacer 99 is selected so that when the tooling is fully closed as shown in FIG. 10*a*, the working surface 100 of coining ring 97 contacts the shell 48 and provides sufficient compression to properly coin the outer edge of panel 50 of shell 48.

As the tooling begins to open, vacuum applied to the shell 48 through passageway 92 in panel form die 86 raises the shell 48 along with upper tooling 61. Since vacuum is also applied to shell 48 through panel form punch 66, to lift the shell 48 from the lower tooling 62, it is necessary to apply a greater vacuum to the upper side of shell 48 than that applied to the lower side. In addition, upward movement of pressure pad 72 by springs 74 aids in initial stripping of shell 48 from lower tooling 62. One shell panel 50 is away from the working surfaces of panel form punch 66 and insert 71, venting of the lower vacuum occuring through additional openings (not shown) in such working surfaces. This reduces the amount of vacuum required on upper tooling 61 to lift the completed shell 48 from lower tooling 62.

After the upper tooling 61 has lifted shell 48 sufficiently to clear lower tooling 62, upward movement of form punch and positioner 84 is halted while upward movement of retainer 80 and panel form die 86 continues. Once these portions clear shell 48 it is removed from the second station tooling and ejected from the shell forming apparatus.

Shell Transfer Apparatus

Figure 11:
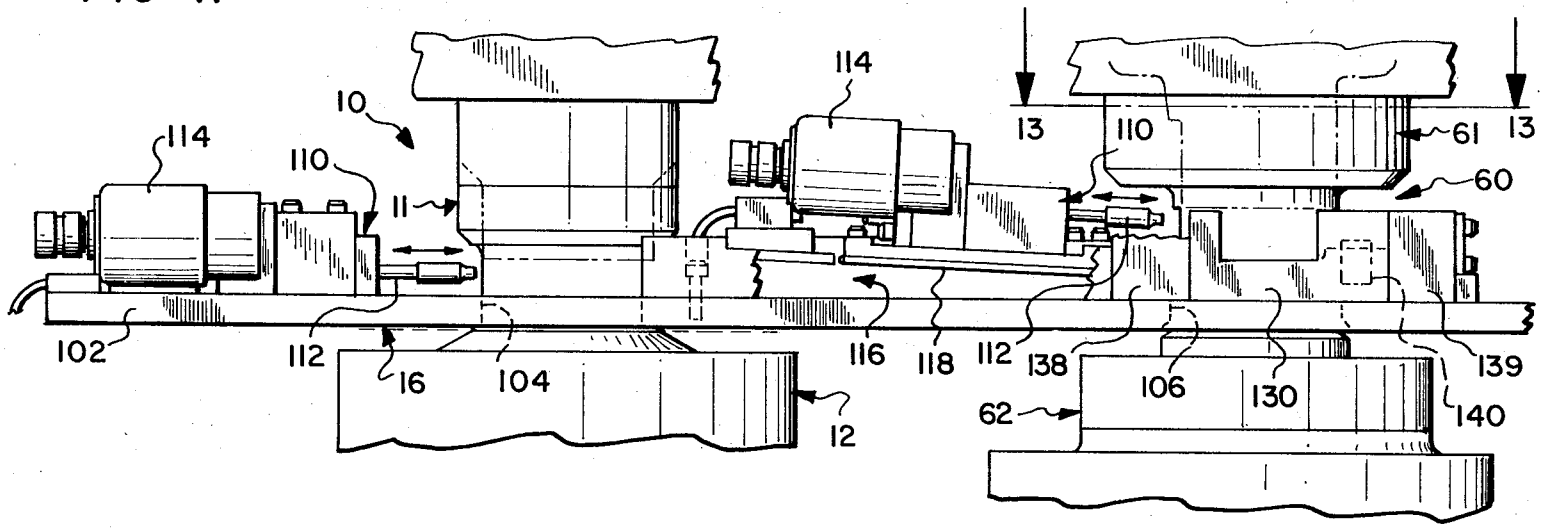
FIG. 11 is an elevational view of a corresponding first and second station, showing the apparatus of the present invention for transferring shells therebetween.

The apparatus of the present invention for transferring shells from the first to the second stations and for transferring the completed shells out of the formation apparatus is shown in detail in FIG. 11. A base member 102 extends between a first station 10 and a corresponding second station 60. An opening 104 is provided at first station 10, of a diameter sufficient to permit passage therethrough of upper tooling 11 as it is moved downwardly by the press ram into contact with lower tooling 12. Similarly, a second opening 106 of a diameter sufficient to permit passage thereinto of upper tooling 61 in base member 102 is provided at second station 60. Lower tooling 62 extends fixedly partially into opening 106, to permit contact with upper tooling 61 as the upper tooling is lowered by the press ram.

The transfer apparatus includes a driver 110 mounted near each station of the formation apparatus. Each driver includes an actuator 112 in the form of an elongated shaft extending from the driver body toward the working surfaces of upper tooling 11 or 61. An air valve 114 is associated with each driver 110, adapted to selectively apply compressed air to driver 110. As will be described in detail below, application of compressed air at the appropriate time to driver 110 causes actuator 112 to extend further from the driver housing. Valve 114 may be any appropriate relatively quick-acting valve, and is preferably a direct acting solenoid valve such as those manufactured by Schrader Bellows Divison of Scovill Mfg. Co. of Akron, Ohio. The valve 114 is selected so that when the airsupply is not connected to driver 110, the driver interior is permitted to exhaust to the atmosphere.

It will be recalled from the foregoing description of shell formation within each station that upon completion of the particular operation within the station, the shell is lifted from the lower tooling 12 or 62. All tooling portions are then opened or retracted such that the shell is held by vacuum in contact only along the uppermost portion of the shell lip 53. When in such position, the shell is properly disposed for transfer by a driver 110. For example, upon completion of the formation operation within first station 10, opening of the tooling in conjunction with the applied vacuum causes the partially completed shell to be held only against knockout and positioner 32. Compressed air is then supplied to driver 110 from an ordinary shop compressed air source, typically at 50–60 psi, so that actuator 112 is extended therefrom and strikes sharply the chuckwall 51 of the shell. Since the shell is in contact with the upper tooling 11 only at the uppermost portion of its lip, the sharp blow from driver 110 propels the shell in free flight from the tooling of first station 10. It is important to note that the shell during such flight does not rest on any solid surface, nor is the shell generally directed by any moving parts. The shell does move along a defined pathway 116, however, and upper stationary guides 118 are provided to prevent the shell from inadvertently leaving path 116.

It will be readily recognized that timing of the transfer of the shell from first station 10 to second station 60 is of great importance, since the shell must be properly positioned within second station 60 in time for lowering of the upper tooling 61. Thus, as will be described below, driver 110 and related items are selected and designed for accurate, quick action. Further, providing a free-flight transfer of the shells ensures that travel time for the shells will not be affected by substantial contact with moving or non-moving parts.

Accordingly, it is also important that each shell leave the first station 10 in a precise manner. Since the shell is held against knock-out positioner 32 by vacuum, the vacuum level must be regulated. Too high a vacuum will affect transfer time by slowing the shell as it leaves the upper tooling 11, making shell transfer sluggish.

One approach is to lower the incoming vacuum level to first station 10. Since vacuum is used at other locations within the press, however, this method requires consideration of the effects of the lowered vacuum or other press functions.

Figure 1A:
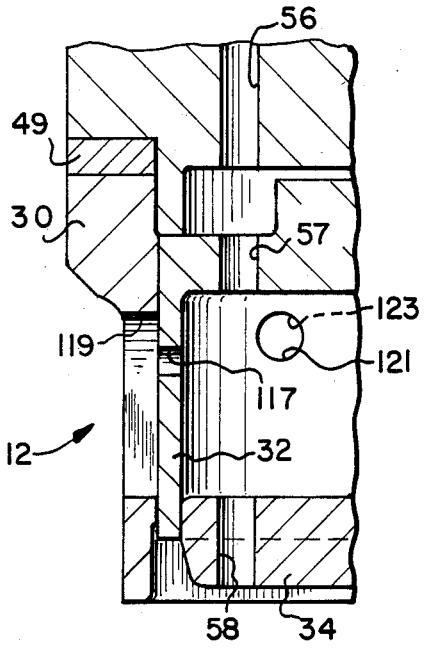
FIG. 1*a* is an enlarged view of the upper first station tooling of FIG. 1, showing the tooling at the bottom of the press stroke.
Figure 1B:
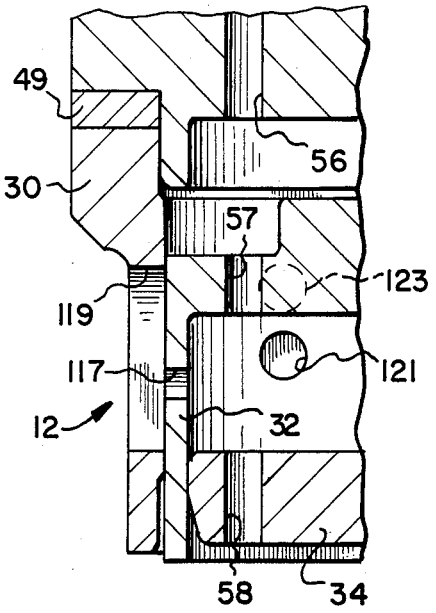
FIGS. 1*b* and 1*c* are views similar to FIG. 1A, showing the tooling partially raised and at the top of the press stroke, respectively.
Figure 1C:
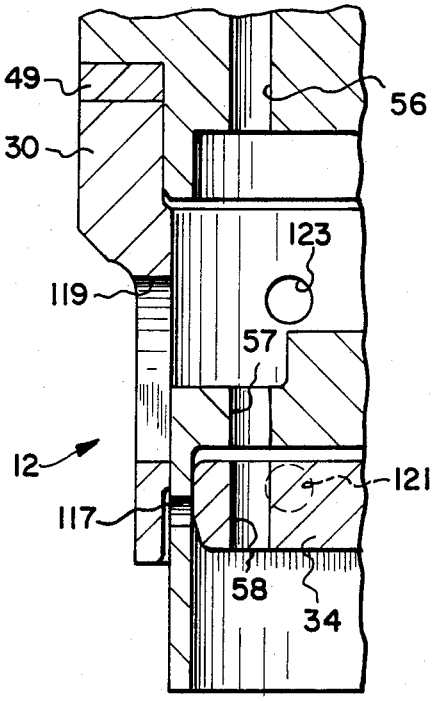

The preferred approach, shown in FIGS. 1*a*–1*c*, is to provide a continuous vacuum bleed to the upper tooling 11 of first station 10. Accordingly, an opening 117 is provided through the wall of knock-out and positioner 32, for cooperation with a slot 119 formed through the wall of blank punch 30. The chamber formed between knock-out and positioner 32 and punch center 34 is therefore vented through opening 117 and slot 119 for all but the uppermost portion of the press stroke (during which portion the shell has already been transferred away), lowering the vacuum applied to the shell to approximately the minimum amount required to retain the shell on knock-out and positioner 32.

To further prevent too high a vacuum level within upper tooling 11, an opening 121 is formed in the wall of knock-out and positioner 32 and an opening 123 is formed in the wall of blank punch 30. By comparing FIGS. 1*a*–1*c*, it can be seen that openings 121 and 123 are aligned at the bottom of the press stroke to cooperate in providing additional venting of the vacuum within upper tooling 11. These openings therefore give total vacuum relief within the tooling immediately prior to raising of the upper tooling 11 to eliminate any vacuum build-up that may have occurred during shell formation.

Opening 123 provides an additional venting function at and just beyond the uppermost portion of the press sroke. By referring to FIGS. 1*a*–1*c* in reverse order, it can be seen that the chamber formed between blank punch 30 and knock-out and positioner 32 is compressed during the downward portion of the press stroke. Although the shell is struck for transferring during the upward portion of the stroke, at typical press speeds, the shell generally will not have cleared the tooling of the first station 10 by the time the press ram reaches the top of its stroke and begins the downward movement.

It has been found that since the vacuum within the upper tooling 11 is only a low vacuum, lowering of the tooling causes air within the chamber between blank punch 30 and knock-out and position 32 to be compressed. In the absence of opening 123, the compressed air flows through vacuum passageways 57 and 58. The downward air stream then strikes any portion of a shell that may still be within the first station 10 below vacuum passageway 58, thereby deflecting the shell from its normal transfer path. This deflection significantly increases the possibility of a failed transfer.

Opening 123 vents the chamber in question during the uppermost portions of the press stroke. Thus, during the portion of the downward press stroke in which the shell is still within first station 10, an additional pathway for the compressed air is provided. This diminishes the air stream from passageway 58 sufficiently to prevent deflection of the shell.

In the preferred embodiment of the present invention, pairs of each of openings 117, 121, and 123 and slot 119 are provided. It will be recognized, however, that depending upon the particular sizes of the various openings and slots, any desired number of each may be used, provided of course that equal numbers of openings 117 and slots 119 and of openings 121 and 123 are selected.

Figure 12:
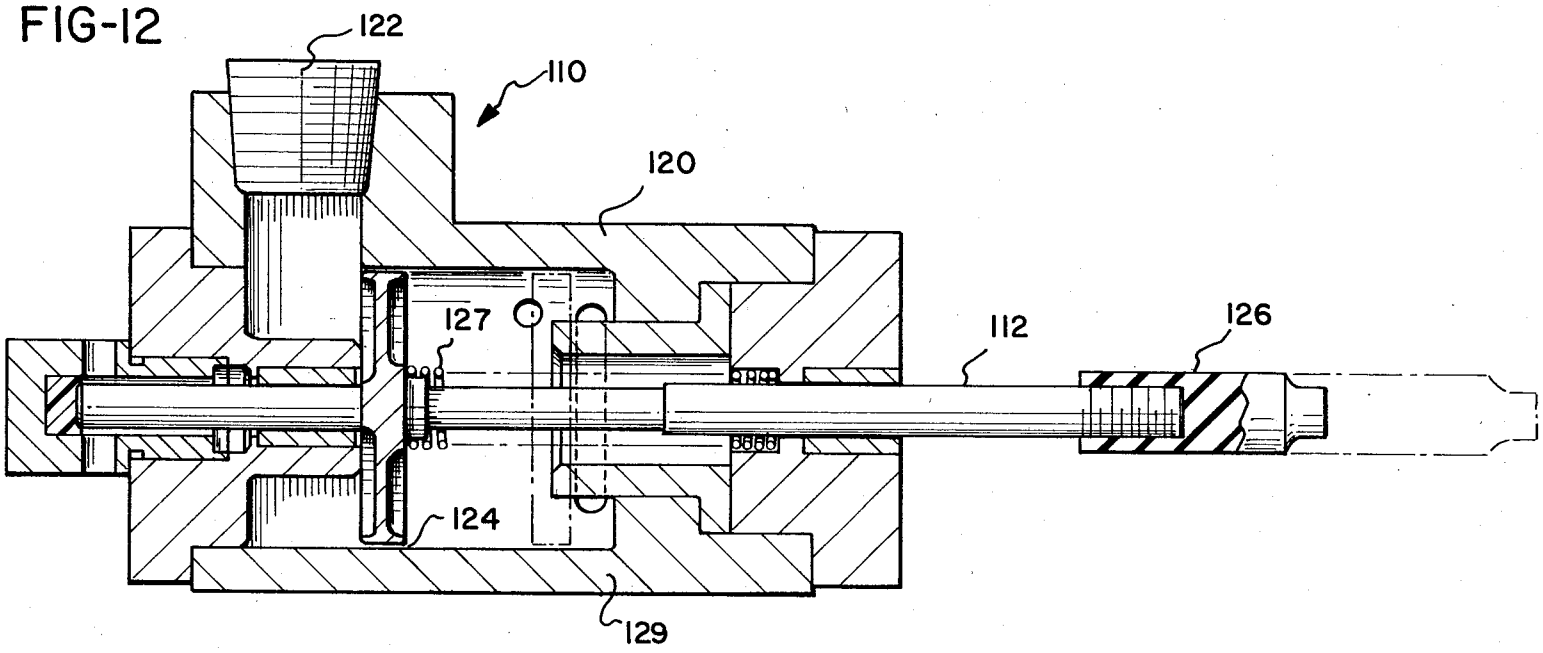
FIG. 12 is a cross-sectional view of a shell piston driver.

The driver 110 is shown in detail in FIG. 12, and includes an exterior housing 120. An opening through housing 120 into the interior thereof is provided with an appropriate fitting 122 for connection of driver 110 to its corresponding air valve 114. A piston 124 is disposed within the interior of housing 120 for movement therealong, and is attached to actuator shaft 112 extending through one end of housing 120. Preferably, piston 124 and actuator shaft 112 are integrally formed as a single piece.

As compressed air is delivered to the interior of housing 120 through fitting 122, the resulting air pressure causes movement of piston 124 so as to result in outward extension of actuator 112. Due to the relative light weight of piston 124 relative the pressure of the incoming air, movement of piston 124 occurs sufficiently rapidly to propel a shell away from the tooling. For example, when constructed according to the preferred embodiment, an average velocity is imparted to the shell typically in the order of 242 in/sec. Shell transfer from first station 10 to second station 60 then occurs in approximately 55 milliseconds. Additionally, the piston 124 need not fit in an airtight relationship within housing 120. Some degree of "leakiness" or by-pass can be tolerated without adversely affecting the performance of driver 110, and in fact, it is preferred that the piston 124 fit only loosely within housing 120, having a piston surface area less than the area of the cross-section of the interior of housing 120. Thus, no seals are required on piston 124, reducing potential sticking and increasing tolerance to contaminants (such as water or oil) carried with the compressed air supply.

To prevent damage to the shell from contact with actuator 112, a tip member 126 formed of an elastomeric material is secured to the distal end of actuator 112. Additionally, a spring 127 is placed about actuator 112 between piston 124 and the end of housing 120, to return piston 124 to its original location following closure of valve 114 and discontinuation of the supply of compressed air to driver 110. A hole 128 is formed through housing 120 so as to be at least partially open and behind piston 124 when in its actuated position. Hole 128 relieves at least part of the air pressure behind piston 124 once fully moved, thereby facilitating return of piston 124 to its original position. Further, a venting slot 129 is defined through housing 120 to vent the interior ahead of as piston 124 as it is moved along the housing interior. By providing venting for air that would otherwise be compressed by piston 124, piston movement is more quickly accomplished, enabling higher press speeds.

Figure 13:
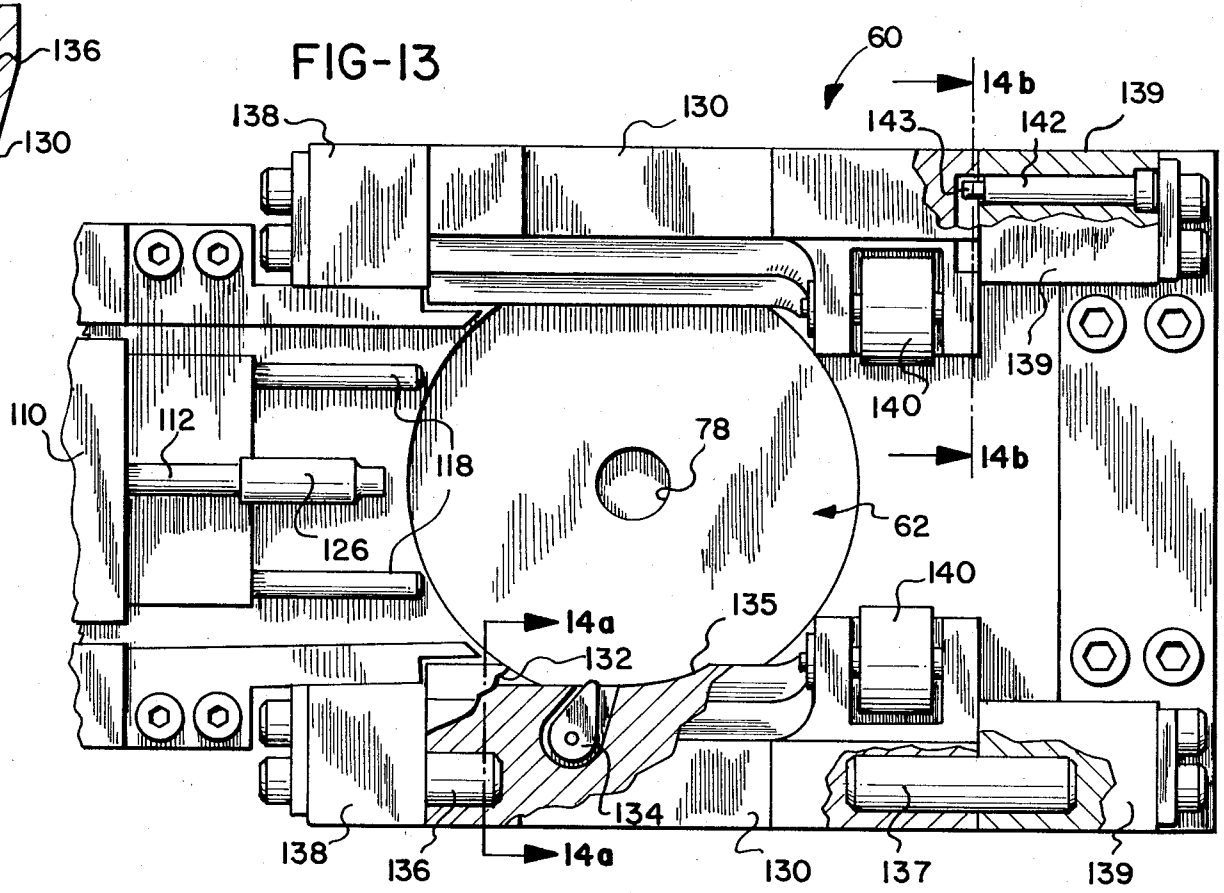
FIG. 13 is a plan view taken generally along line 13—13 of FIG. 11.
Figure 14A:
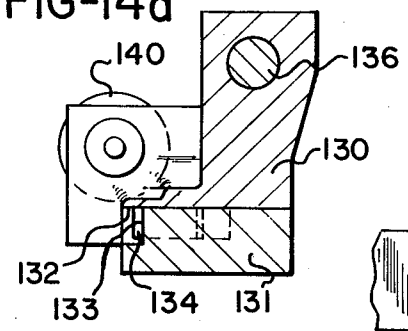
FIG. 14*a* is a sectional view taken generally along line 14*a*—14*a* of FIG. 13.

The apparatus for capturing and locating a moving shell within a second station may be seen in detail in FIG. 13. A shell entering second station 60 following its partial formation at the corresponding first station moves into the apparatus beneath guide bars 118. The shell then enters between a pair of locating fingers 130 positioned about either side and slightly above lower tooling 62. As seen in FIGS. 13 and 14*a*, each finger 130 includes an attached lower portion 131 that includes a recessed portion for defining an upper flange 132 and path wall 133 that retain the shell within the pathway along which the shell enters between fingers 130. A spring loaded pawl 134 is carried in lower portion 131 and extends slightly into the pathway from each portion 131 to prevent rebounding of the shell as it reaches the end curved surface 135 of the pathway defined by path walls 133. The shell is then properly located over lower tooling 62 and, once it has been halted, the shell drops from fingers 130 into lower tooling 62. The vacuum supplied to the lower tooling through opening 78 increases the speed with which the shell is moved into its proper position, and facilitates retention of the shell in such position.

Each finger 130 is pivotally mounted by pins 136 and 137 to blocks 138 and 139, respectively, secured to the base member 102. A cam roller 140 is mounted to each finger 130 to cooperate with a plate cam (not shown) mounted to the upper tooling. As the press ram is lowered for the completion of shell formation, the plate cams contact rollers 140, pivoting fingers 130 about pins 136 and 137 to provide proper clearance for the tooling as it closes.

Figure 14B:
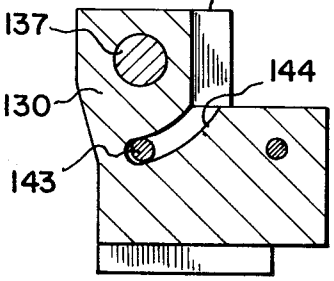
FIG. 14*b* is a sectional view taken generally along line 14*b*—14*b* of FIG. 13.

Appropriate springs (not shown) are provided for each finger 130 to return the fingers to their proper position as the tooling is opened. In addition, a pin 142 is mounted within each block 139 below pin 137, and includes a projection 143 fittable within an arcuate slot 144 formed within finger 130 as shown in FIG. 14*b*. Projection 143 cooperates with slot 144 to serve as a stop for finger 130 to properly position the finger for receiving the next shell.

Referring again to FIG. 11, opening of the tooling at second station 60 causes the completed shell to be lifted upward with upper tooling 61 by the stronger vacuum applied thereto. Once the tooling has been completely opened, and all portions cleared from the completed shell so that the shell contacts upper tooling 61 only along the uppermost edge of its lip portion 100, a second driver 110 is energized by valve 114. Actuator 112 then strikes the completed shell along its chuck wall, driving the shell from the second station 60 into an appropriate receiving bin or the like. It will be recognized, of course, that transfer of the shell from the second station 60 is substantially identical to that performed from first station 10. Since the shells are merely collected, however, rather than accurately positioned for further operation, the exact path of the shell leaving second station 60 is not as critical as the path for leaving first station 10.

Multiple Shell Formation

Figure 15:
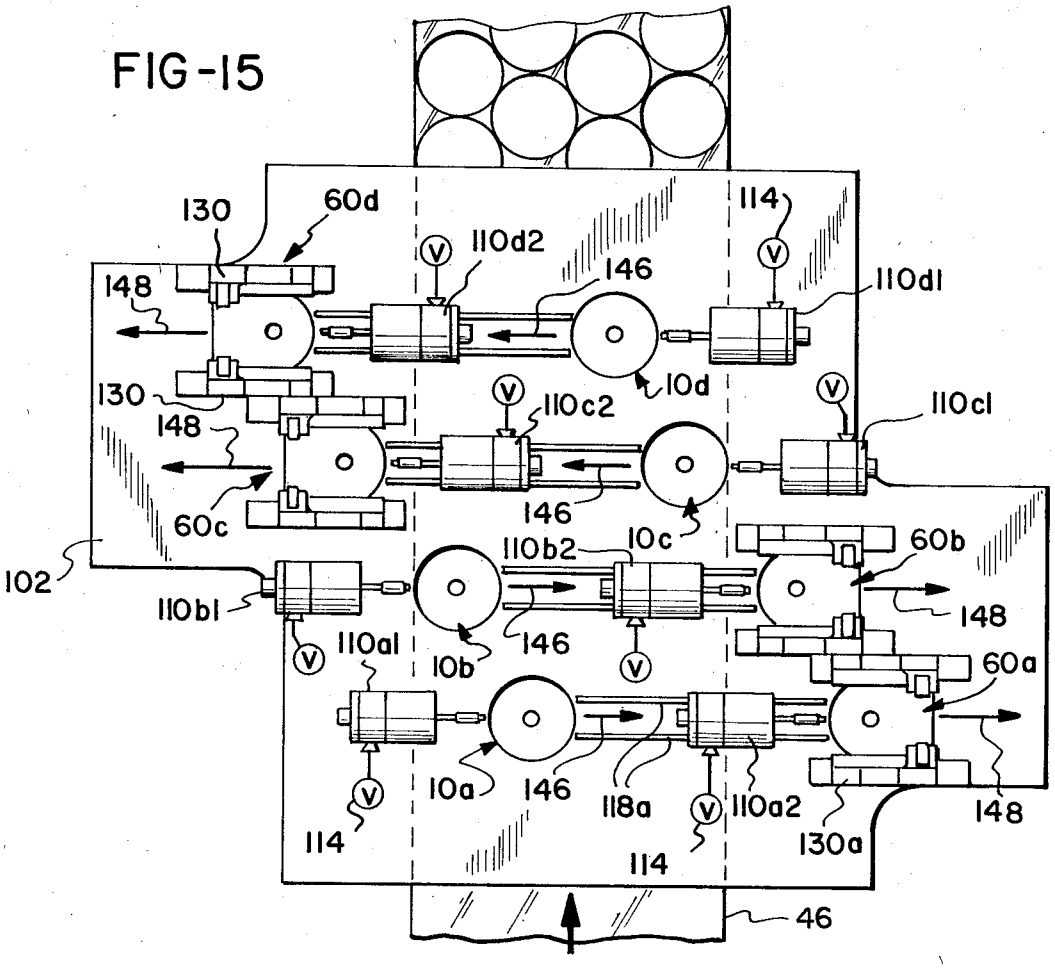
FIG. 15 is a plan view of the transfer apparatus provided for a press adapted to produce four shells simultaneously.

The tooling and transfer apparatus having been described in detail, it should be recognized that a press such as that described in the preferred embodiment incorporating the apparatus of the present invention will typically include a plurality of first stations, corresponding second stations, and transfer apparatus. This will enable greater quantities of shells to be formed within a given time, and in one example, apparatus for simultaneous manufacture of four shells is shown in FIG. 15.

Stock 46 is fed into the press beneath base member 102 supporting the transfer apparatus. Four first stations 10*a*–10*d* are provided for severing a blank from the stock 46 and partially forming the shell. Each of first stations 10*a*–10*d* includes a corresponding driver 110*a*-1–110*d*1. Following completion of the operation at each first station, the corresponding driver is actuated to transfer the shell along the transfer path as indicated by arrows 146 to a corresponding section 60*a*–60*d*.

At each second station 60*a*–60*d*, fingers 130 operate to accurately position the shell within the lower tooling of the second station. During the next stroke of the press following that which partially formed the shells at the first stations, the tooling at each second station 60*a*–60*d* closes, thereby completing formation of each shell. Following opening of the tooling, a corresponding driver 110*a*2–110*d*2 is actuated to transfer the completed shells from each of the second stations 60*a*–60*d*, as indicated by arrows 148. It should be recognized that at the same time that formation of the shells is completed within the second stations 60*a*–60*d*, the next succeeding set of four blanks is punched from the stock 46 and partially formed within the first stations 10*a*–10*d*.

Press Control System

Figure 16:
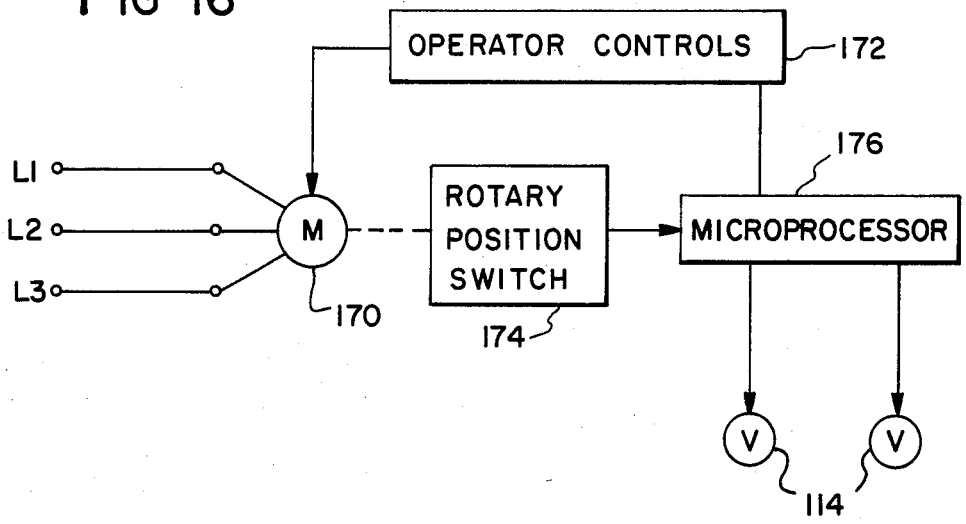
FIG. 16 is a diagram illustrating schematically the control system for operation of the press.

The electrical control means for controlling operation of the press for the manufacture of shells is shown schematically in FIG. 16. Power is supplied to main drive motor 170 through lines L1, L2 and L3 for driving the press ram to open and close the tooling of the first and second stations. A series of operator controls 172, which may be mounted on one or more conveniently located control panels, enable the press operator to control stopping, starting and speed of the press, as well as to control and monitor various other press functions.

A number of press functions are controlled by a programmable rotary position switch 174 that provides a variety of separate switching functions, each of which may be adjusted to open and close switching contacts at predetermined angular positions. Rotary switch 174 is mounted for operation to the press frame, and is coupled to the rotary press ram drive through a drive chain or the like, and hence is coupled indirectly to motor 170 as indicated in FIG. 16. The switch is connected to the ram drive so that the switch position designated 0° coincides with the uppermost position of the press ram stroke. The electrically operated functions of the press are directed by a microprocessor 176 which interfaces with operator controls 172 and rotary position switch 174. The microprocessor 176 is programmed to control various press functions in proper timing and sequence.

As has been described, each partially completed and completed shell formed by the press is transferred from a press tooling station by striking the shell with the actuator 112 of a driver 110. Driver 110 is in turn actuated by a solenoid-operated air valve 114, two such valves 114 being shown in FIG. 16 for purposes of example. The solenoids of valve 114 are energized at the appropriate points in each press stroke by microprocessor 176 in response to signals received from rotary position switch 174.

Normally, micropressor 176 causes each of valves 114 to be energized whenever rotary switch 174 reaches the position of 288°. It should be noted that this position for rotary switch 174 will occur when the press ram has completed most of its upward stroke and the shell has been properly positioned. Each shell will then be struck with the actuator 112 of a driver 110 and will be transferred away from its respective tooling station.

The total time required for a valve 114 to open and driver 110 to extend actuator 112 is approximately 15 milliseconds. This interval is, of course, constant at all press speeds. Consequently, although each valve 114 is energized at a fixed angular position, the angular position of the rotary switch 174 (and hence the stroke position of the press ram) at the time shell impact actually occurs varies with the speed of the press. For example, at 300 strokes per minute, the rotary switch 174 has reached 315° when the shell is struck.

To partially reduce this delay with respect to rotary switch angle, microprocessor 176 causes valves 114 to be energized at 273° rather than 288° at press speeds above 300 strokes per minute. A time measurement of the duration of two press strokes, as indicated by signals from rotary position switch 174, is converted by microprocessor 176 into an average speed determination used to define whether press speed is greater or less than 300 strokes per minute.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. Apparatus for transferring a relatively flat object from a first station to a second station, comprising:

means within the first station for supporting the object at the first station;

means located adjacent the first station for striking a blow edgewise of the object to direct the object edgewise to the second station along a predetermined path;

a pair of fingers disposed in a spaced relationship at the second station to define between said fingers a portion of said path for an object, said path portion so defined being of a width slightly greater than the object along the entire length of the path;

each of said fingers having a flange extending inwardly therefrom at substantially the top thereof so as to extend at least partially over said path portion;

each of said fingers further defining a path wall having an end surface extending generally into said object path at a location along said finger remote from the point of entry of an object between said fingers, each said end surface extending inwardly sufficiently to block a portion of said object path for halting movement of the object; and a spring pawl carried within each of said fingers, extending partially into said object path and constructed to permit movement of the object therepast without halting the object for entering the pathway, but to prevent movement of the object therepast in the reverse direction, said pawls being positioned along said fingers for preventing rebounding of the object from said end surfaces.

2. Apparatus as defined in claim 1, further comprising means located within the second station for supporting the object at the second station disposed at a level at least slightly below said object path, and means located within the second station for moving an object downwardly from said object path toward said supporting means, so that upon halting movement of the object by said end surfaces, the object is moved from said path onto said supporting means.

3. Apparatus as defined in claim 2, wherein said object moving means includes means for supplying a partial vacuum to said second station object supporting means through at least one vacuum orifice defined therein.

4. Apparatus as defined in claim 1, wherein said means for striking a blow edgewise of said object includes:

a substantially closed housing defining a housing interior;

a piston having a working surface disposed at a normal position within said housing interior for sliding movement therein to an activated position;

an actuator extending through said housing and connected to said piston for sliding movement thereby;

means connected to said housing for selectively directing compressed air into said housing and against said working surface for movement of said piston to said activated position; and means operatively connected to said piston for returning said piston to said normal position;

said housing being located with respect to said object supporting means so that movement of said piston causes said actuator to strike said blow edgewise of the object for propelling the object toward the second station.

* * * * *